US010273045B2

(12) United States Patent
White

(10) Patent No.: US 10,273,045 B2
(45) Date of Patent: Apr. 30, 2019

(54) KNOCKDOWN CRATE AND METHOD OF DISPLAY PACKAGING

(71) Applicant: William C White, Norfolk, VA (US)

(72) Inventor: William C White, Norfolk, VA (US)

(73) Assignee: Adeptus IP, LLC, Norfolk, VA (US)

( * ) Notice: Subject to any disclaimer, the term of this patent is extended or adjusted under 35 U.S.C. 154(b) by 150 days.

(21) Appl. No.: 14/509,921

(22) Filed: Oct. 8, 2014

(65) Prior Publication Data

US 2016/0101896 A1 Apr. 14, 2016

(51) Int. Cl.

| | |
|---|---|
| ***B65D 21/08*** | (2006.01) |
| ***B65D 6/16*** | (2006.01) |
| ***B65D 25/30*** | (2006.01) |
| ***B65D 6/02*** | (2006.01) |
| ***B65D 6/24*** | (2006.01) |

(52) U.S. Cl.

CPC ..... *B65D 21/086* (2013.01); *B65D 9/06* (2013.01); *B65D 9/12* (2013.01); *B65D 11/18* (2013.01); *B65D 11/1873* (2013.01); *B65D 25/30* (2013.01)

(58) Field of Classification Search

CPC ... B65D 9/12; B65D 9/22; B65D 9/24; B65D 21/086; B65D 11/1873; B65D 9/32; B65D 11/18

See application file for complete search history.

(56) References Cited

U.S. PATENT DOCUMENTS

| | | | | | |
|---|---|---|---|---|---|
| 653,514 | A | * | 7/1900 | Kasschau | B65D 9/12 217/12 R |
| 947,625 | A | * | 1/1910 | Cummer | B65D 9/12 217/12 R |
| 2,593,779 | A | * | 4/1952 | McGrath | B65D 9/12 217/12 R |
| 3,741,425 | A | * | 6/1973 | Freeman | B65D 9/12 217/12 R |
| 5,193,701 | A | * | 3/1993 | Bush | B42F 15/007 206/425 |

* cited by examiner

*Primary Examiner* — Andrew T Kirsch
*Assistant Examiner* — Don M Anderson
(74) *Attorney, Agent, or Firm* — Bryce D. Miracle; Pierce McCog, PLLC

(57) ABSTRACT

An improved knockdown crate and method of display for sale thereof. The knockdown crate generally includes two end panels, each with a bottom edge and opposing side edges, each edge comprising an interior groove extending the length thereof; a bottom panel comprising a plurality of longitudinal slats and two transverse connection members connecting the plurality of longitudinal slats in parallel, the transverse connection members have a geometric cross section which seat with the interior grooves of the bottom edges of the two end panels; and two side panels each comprising a plurality of longitudinal slats and two transverse connection members connecting the plurality of longitudinal slats in parallel, the transverse connection members have a geometric cross section which seat with the interior grooves of the opposing side edges of the two end panels respectively.

8 Claims, 18 Drawing Sheets

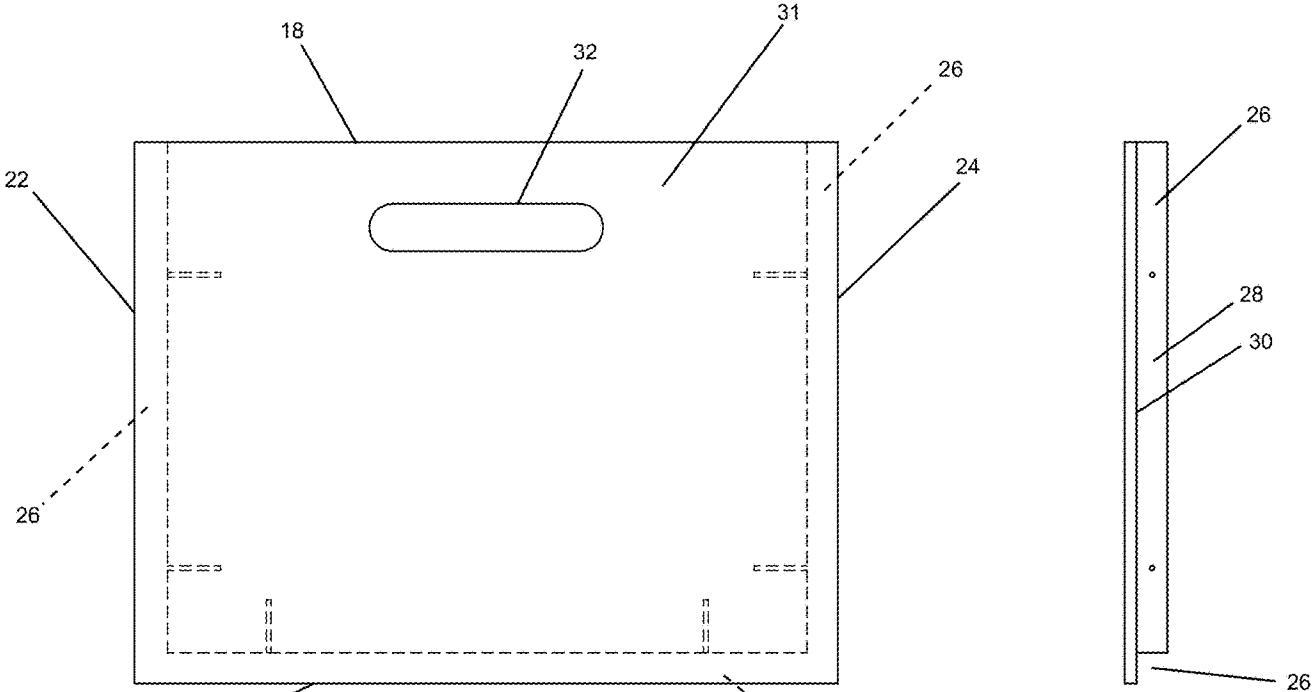
FIG. 3C
FIG. 3A
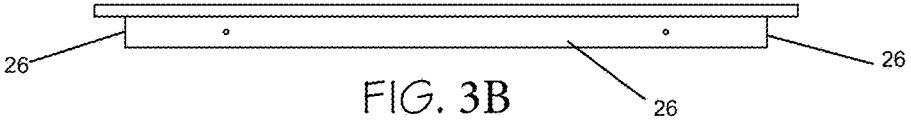
FIG. 3B

KNOCKDOWN CRATE AND METHOD OF DISPLAY PACKAGING

BACKGROUND

The present invention relates to a knockdown crate, and more particularly to an improved version and a method of display for sale thereof.

Knockdown or collapsible crates are conventionally used for storing and transporting various items. Knockdown crates can be collapsed or unassembled (i.e., folded or stacked into a relatively flat configuration) for space-efficient storage and can be expanded (i.e., assembled from a flat position) to define a relatively rigid structure for holding and protecting goods.

Knockdown crates typically define a base and four sidewalls. The four sidewalls are generally detachable so that the crate can be collapsed. During use, in the assembled position, knockdown crates are routinely stacked one atop the next with goods or other items stored within.

Applicant has identified a number of deficiencies and problems associated with the manufacture, design, and use of conventional knockdown crates. Through applied research, effort, ingenuity, and innovation, Applicant has solved many of these identified problems by developing a unique version embodied by the present invention, which is described in detail below.

SUMMARY

The present invention addresses current needs and achieves other advantages by providing a knockdown crate that is light weight, easy to assemble, and inexpensive to manufacture, ship and sell. Thereby providing the end consumer with a superior product at a competitive cost.

Generally, in a version of the invention, the knockdown crate includes (a) two end panels, each with a bottom edge and opposing side edges, each edge comprising an interior groove extending the length thereof; (b) a bottom panel comprising a plurality of longitudinal slats and two transverse connection members connecting the plurality of longitudinal slats in parallel, the transverse connection members have a geometric cross section which seat with the interior grooves of the bottom edges of the two end panels. Ideally, the transverse ends of the bottom panel overlap the bottom edge of their respective end panels forming a right angle assembled edge; and (c) two side panels each comprising a plurality of longitudinal slats and two transverse connection members connecting the plurality of longitudinal slats in parallel, the transverse connection members have a geometric cross section which seat with the interior grooves of the opposing side edges of the two end panels respectively. Preferably, the transverse ends of the two side panels overlap the opposing side edges of their respective end panels forming right angle assembled edges and the bottom edges of the two side panels overlap the longitudinal edges of the bottom panel to form right angle assembled edges.

In a version of the invention, the bottom panel transverse connection members and the two side panel connection members are adapted to seat with their respective end panel interior grooves which form uniform, flat interior end walls when the knockdown crate is assembled.

Moreover, the invention may comprise a unique method of packaging and displaying the crates for sale at a retail location. The first step in the unique method is to (a) provide at least one unassembled knockdown crate which includes (i) two end panels, each with a bottom edge and opposing side edges, each edge comprising an interior groove extending the length thereof; (ii) a bottom panel comprising a plurality of longitudinal slats and two transverse connection members connecting the plurality of longitudinal slats in parallel, the transverse connection members have a geometric cross section which seat with the interior grooves of the bottom edges of the two end panels; and (iii) two side panels each comprising a plurality of longitudinal slats and two transverse connection members connecting the plurality of longitudinal slats in parallel, the transverse connection members have a geometric cross section which seat with the interior grooves of the opposing side edges of the two end panels respectively. The second step is to (b) uniformly stack and pack each unassembled knockdown crate into a rectangular tray, wherein the bottom panel, two end panels, and two side panels are each individually stacked one atop of the other. Next, (c) each rectangular tray containing an unassembled knockdown crate is stacked into a display box, wherein the exterior of the display box advertises the contents therein for display at a retail location and finally, (d) at least one display box containing the packaged knockdown crates are put on display and offered for sale at the retail location.

In an alternate version of the invention, the step of (b) uniformly stacking and packing each unassembled knockdown crate, further comprises positioning the bottom panel above the side panels and end panels within the tray, and shrink wrapping the tray in order to secure the knockdown crate within the tray. This provides a potential purchaser with the ability to view the quality and construction of the knockdown crate while in the packaging during display at the retail location.

In another version of the method of packaging and display, the unassembled panels of the knockdown crate are uniformly stacked and shrink wrapped without the use of a rectangular tray before being loaded into the display box.

Other version of the knockdown crate and display thereof may comprise other variations and combinations. The aforementioned version should not be construed in the limiting sense.

BRIEF DESCRIPTION OF THE DRAWINGS

These and other features, aspects, and advantages of the present invention will become better understood with regard to the following description and accompanying figures where:

FIG. 3A is a front elevation view of an end panel of the version shown in FIG. 1;

FIG. 3B is a bottom plan view of the end panel of the version shown in FIG. 3A;

FIG. 3C is a right side elevation view of the end panel of the version shown in FIG. 3A;

DETAILED DESCRIPTION

Referring now to the figures wherein the showings are for purposes of illustrating a preferred version of the invention only and not for purposes of limiting the same, the present invention is a novel version of a knockdown crate.

The following detailed description is of the best currently contemplated modes of carrying out exemplary versions of the invention. The description is not to be taken in the limiting sense, but is made merely for the purpose illustrating the general principles of the invention, since the scope of the invention is best defined by the appended claims.

Various inventive features are described below that can each be used independently of one another or in combination with other features.

Figure 1:
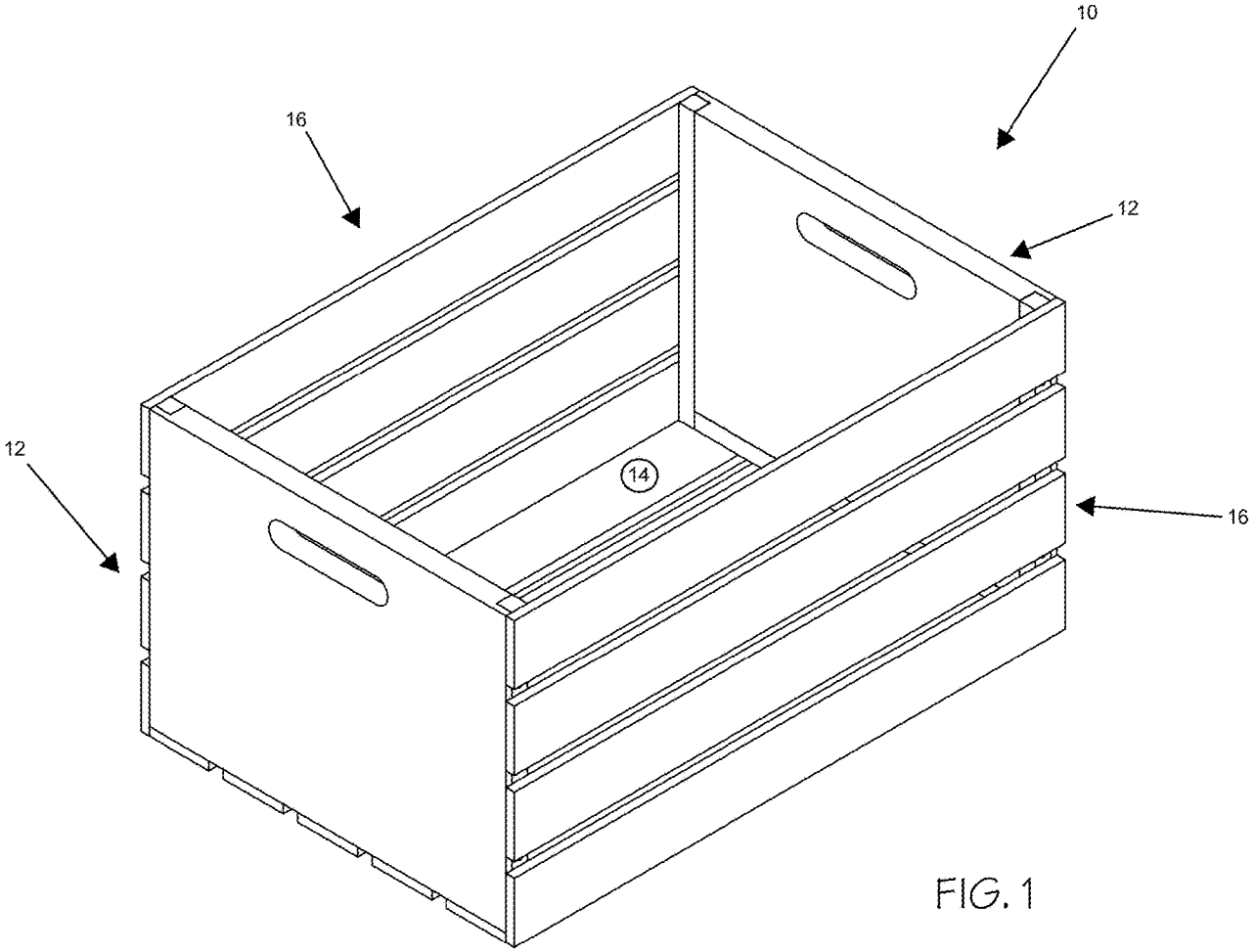
FIG. 1 is a front perspective view of a version of the knockdown crate.
Figure 2:
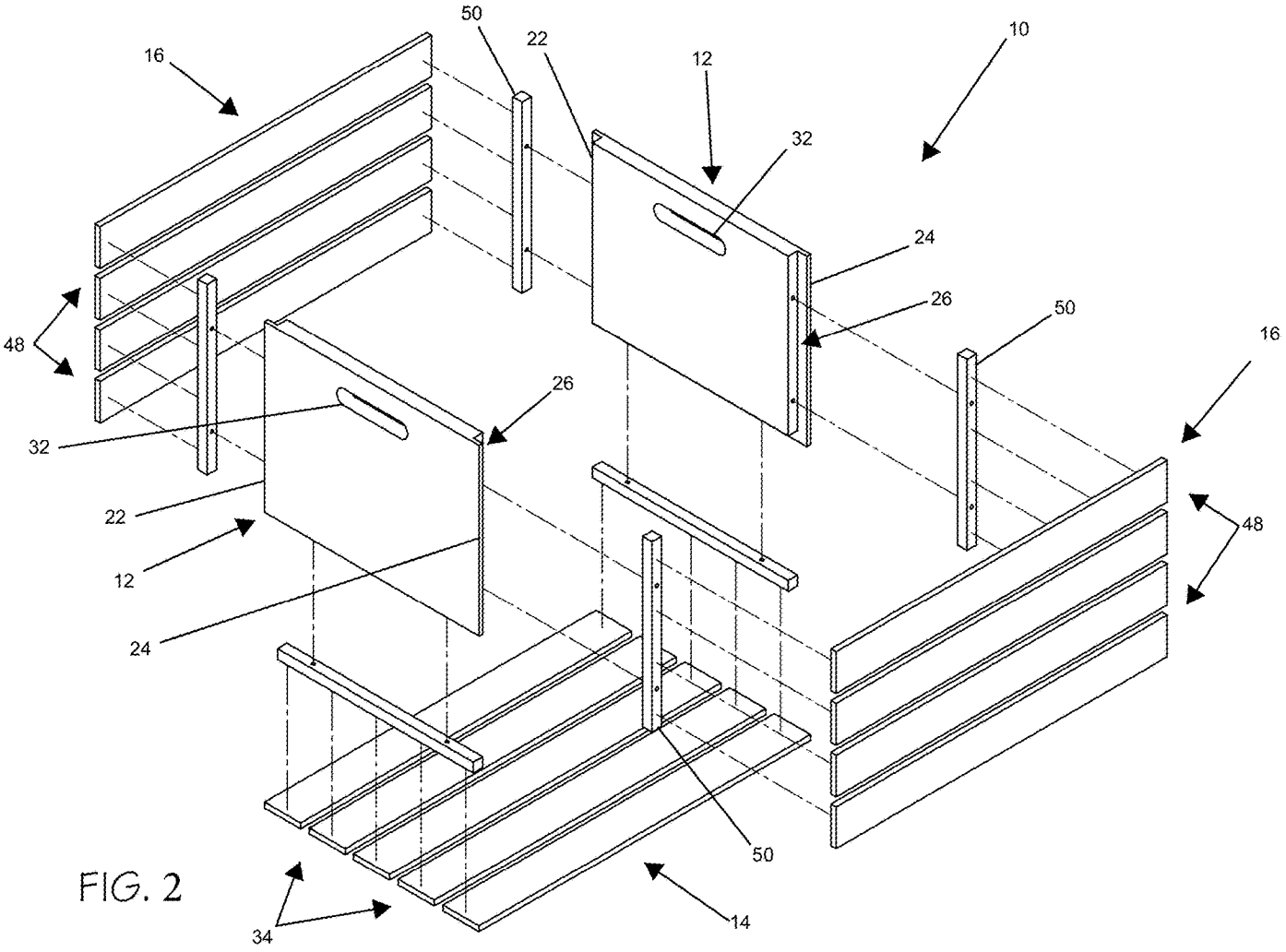
FIG. 2 is a front exploded perspective view of the version shown in FIG. 1.

With reference now to the drawings, and in particular to FIG. 1 and FIG. 2 thereof, a new knockdown crate 10 embodying the principles and concepts of the present invention are shown.

As best illustrated by FIG. 1 and FIG. 2, the knockdown crate version 10 generally comprises two end panels 12, a bottom panel 14, and two side panels 16. The two end panels 12 are positioned in parallel and opposed to each other and the two side panels 16 are positioned in parallel and are opposed to each other, each end panel 12 and side panels 16 are positioned about the perimeter of the bottom panel 14 forming the crate 10.

The two end panels 12 are symmetrical and identical with each other, both having the same width, length and depth forming a rectangular shape. As illustrated in the figures, particularly FIG. 3A-FIG. 3C, the two end panels 12 are generally made of a solid material with sufficient depth for providing a rigid, durable panel that will withstand loads endured throughout transport of the knockdown crate. The two end panels 12 each have a top edge 18, bottom edge 20 and opposing side edges 22 and 24. The top edge 18 comprises a generally flat surface. The bottom edge 20, and opposing side edges 22 and 24 each include an interior groove 26 which extends the length of each edge. In the version 10, the interior grooves 26 have an L-shape cross section defining two longitudinally extending perpendicular flat surfaces 28 and 30 which extend along each of the bottom edge 20 and opposing side edges 22 and 24. It will be known that the shape of the interior grooves 26 may be configured to have different cross sections in order to carry out the invention.

Each of the end panels 12 has an equivalent elongated handle opening 32 which is positioned near the upper portion of the end panel 12 near the top edge 18. The length and height of the elongated handle openings 32 are sufficient to accommodate carrying the knockdown crate 10 by hand as commonly known in the industry.

Figure 4A:
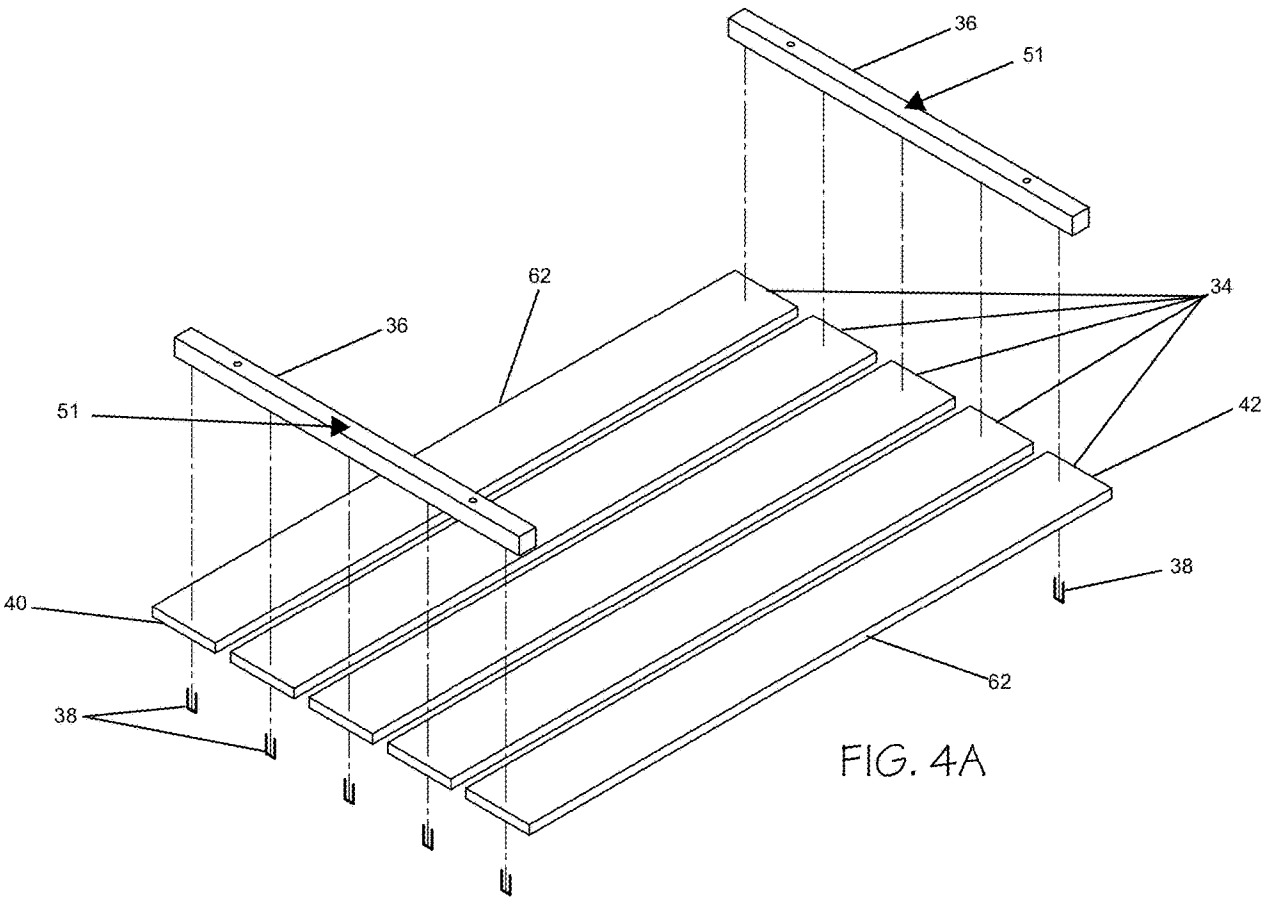
FIG. 4A is an exploded perspective view of the bottom panel of the version shown in FIG. 1.

As best illustrated by FIG. 4A, the knockdown crate 10 includes a bottom panel 14. The bottom panel 14 is formed by a plurality of longitudinal slats 34 and two transverse connection members 36. Ideally, the longitudinal slats 34 are an elongated vertical strip of wood with sufficient depth to provide adequate strength. The transverse connection members 36 connect the plurality of longitudinal slats 34 in parallel forming the bottom panel 14. In the version, there are five longitudinal slats which make up the plurality of longitudinal slats 34. Staples 38 may be used to attach the longitudinal slats 34 with the transverse connection members 36. Each transverse connection member 36 is positioned parallel and near each of the bottom panel 14 transverse end edges 40 and 42.

As best illustrated in FIG. 2, and FIG. 4A-FIG. 4E, the bottom panel 14 transverse connection members 36 have a rectangular geometric cross section and are of sufficient length which is configured to seat and fit within the interior grooves 26 of the bottom edges 20 of the two end panels 12 respectively. It is preferable that the fitting is configured to support the transverse end edges 40 and 42 of the bottom panel 14 to overlap with the bottom edge 20 of their respective end panels 12 to form right angle assembled edges 44 and 46.

Alternatively, it will be known that the bottom panel 14 may be a solid surface as opposed to using a plurality of longitudinal slats 34. Moreover, the longitudinal slats 34 can vary in size with respect to one another, however, preferably they are all of similar dimension and construction.

Figure 4B:
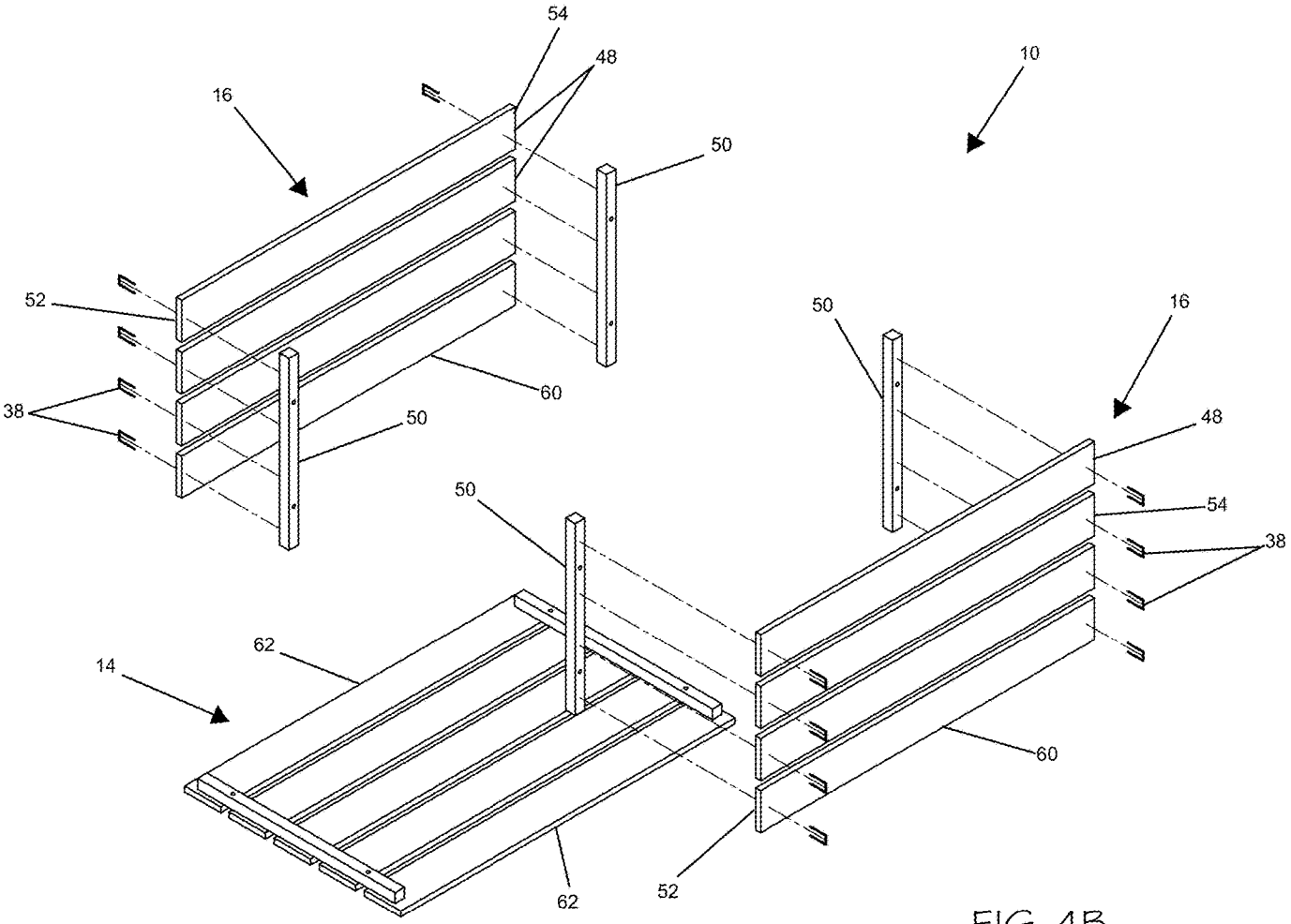
FIG. 4B is an exploded perspective view of the two side panels and bottom panel of the version shown in FIG. 1.

As particularly shown in FIG. 4B, the knockdown crate 10 includes two side panels 16. The two side panels 16 are formed by a plurality of longitudinal slats 48 and two transverse connection members 50. Ideally, the longitudinal slats 48 are an elongated vertical strip with sufficient depth to provide adequate barrier strength. The transverse connection members 50 connect the longitudinal slats 48 in parallel which form the side panels 16. In the version, there are four longitudinal slats which make up the plurality of longitudinal slats 48 for each side panel 16. Staples 38 may be used to attach the longitudinal slats 48 with the transverse connection members 50. Each transverse connection members 50 is positioned parallel and near each of the two side panel 16 opposing side edges 52 and 54.

As best illustrated in FIG. 2 and FIG. 4A-FIG. 4E, the two side panel 16 transverse connection members 50 generally have a rectangular geometric cross section and are of sufficient length which is configured to seat and fit within the interior grooves 26 of the opposing side edges 22 and 24 of the two end panels 12 respectively during assembly. It is preferable that the fitting is configured to support the opposing side edges 52 and 54 of the two side panels 16 to overlap the opposing side edges 22 and 24 of their respective end panels 12 forming right angle assembled edges 56 and 58. Moreover, it is preferable that the fitting is configured to support the bottom edges 60 of the two side panels 16 to overlap the longitudinal edges 62 of the bottom panel 14 to form right angle assembled edges 64 and 66.

Alternatively, it will be known that the two side panels 16 may be a solid surface as opposed to using a plurality of longitudinal slats 48. Moreover, the longitudinal slats 48 can vary in size with respect to one another, however, preferably they are all of similar dimension and construction.

Ideally, cooperatively the bottom panel 14 transverse connection members 36 and the two side panel 16 transverse connection members 50 are adapted to fit with their respective end panel 12 interior grooves 26, to form uniform, flat end walls 68 and 70 when the crate 10 is in the assembled position.

Figure 4C:
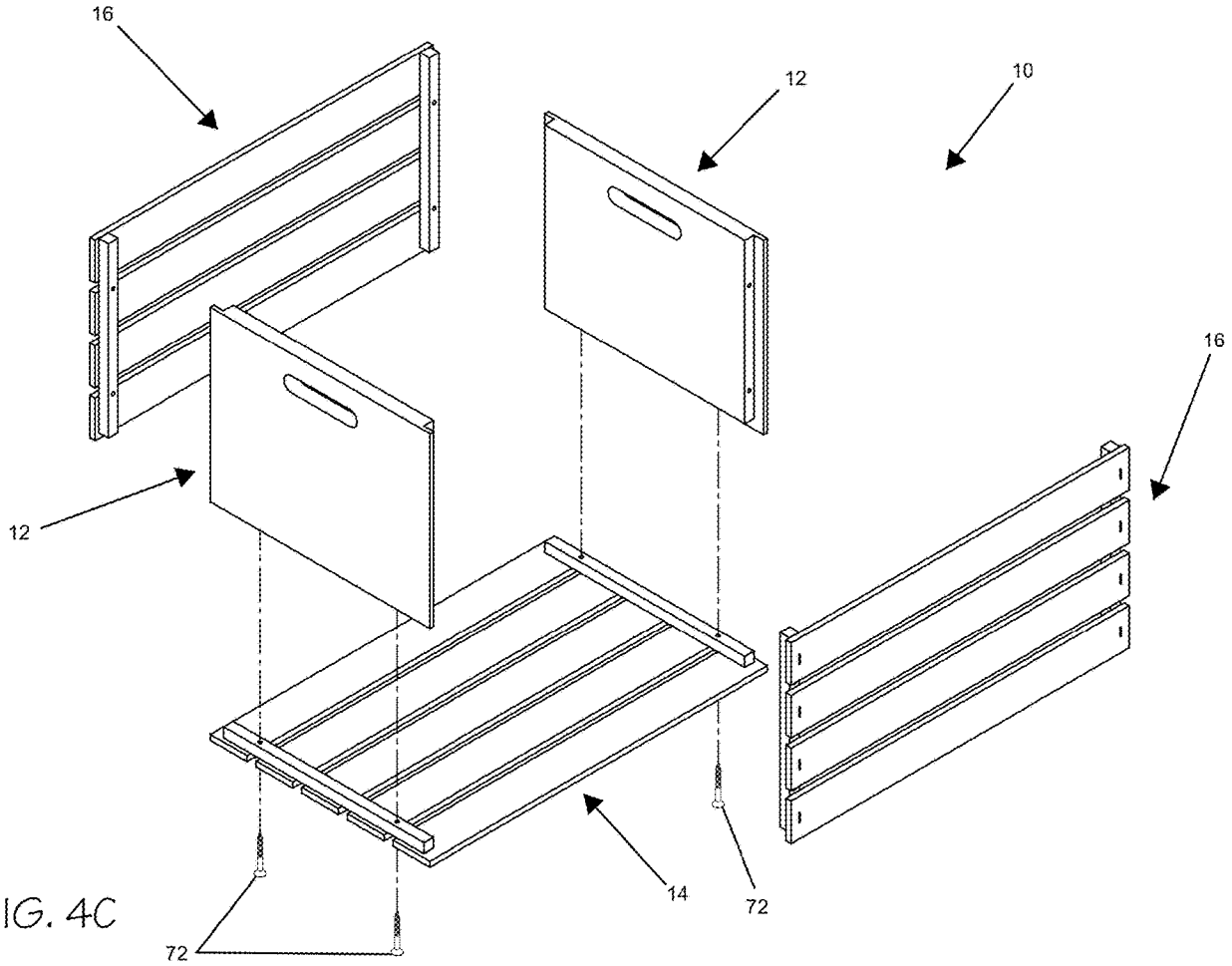
FIG. 4C is a perspective view of the assembly of the bottom panel of the knockdown crate of the version shown in FIG. 1.
Figure 4D:
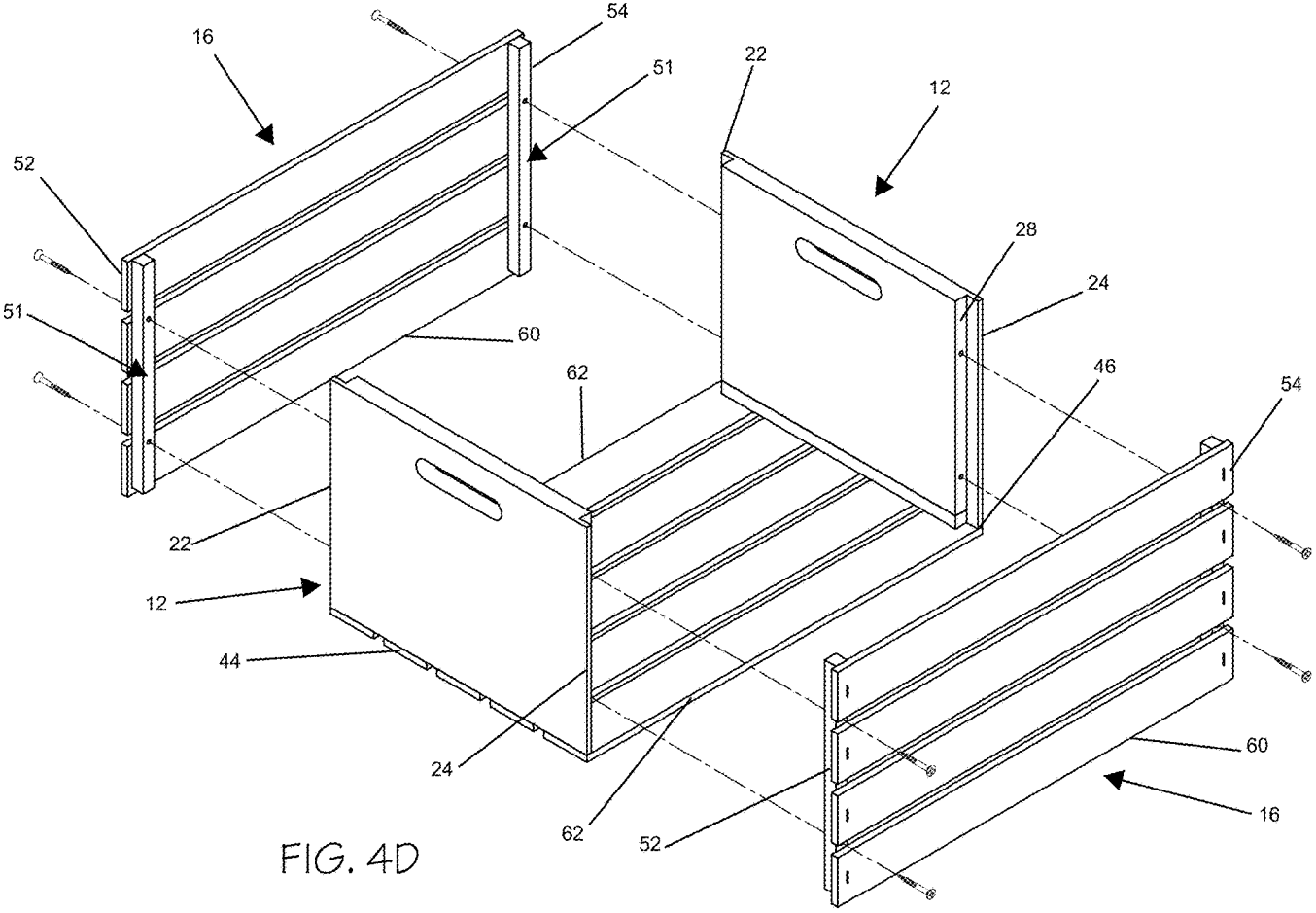
FIG. 4D is a perspective view of the assembly of the side panels of the knockdown crate of the version shown in FIG. 1.
Figure 4E:
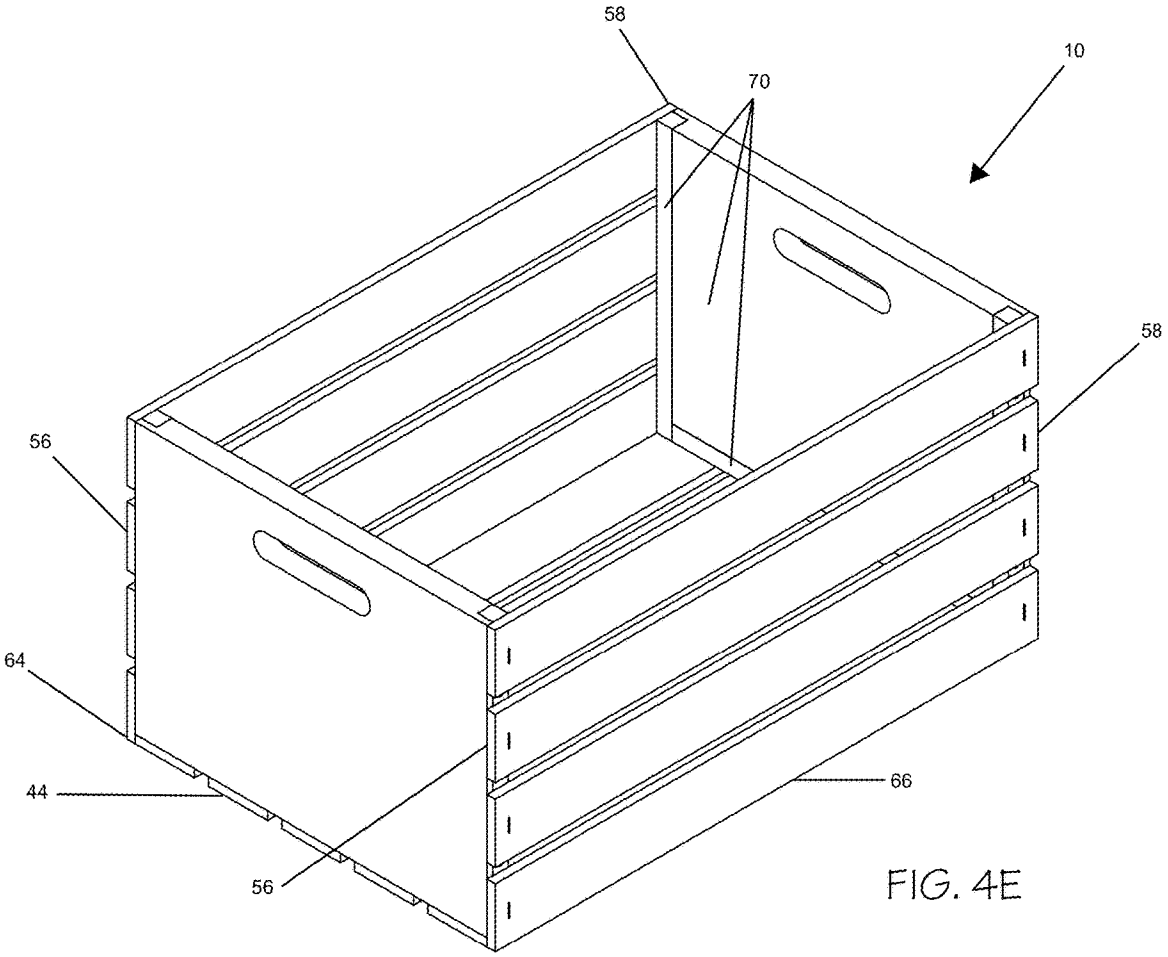
FIG. 4E is front perspective view of the assembled knockdown crate of the version shown in FIG. 1.
Figure 4F:
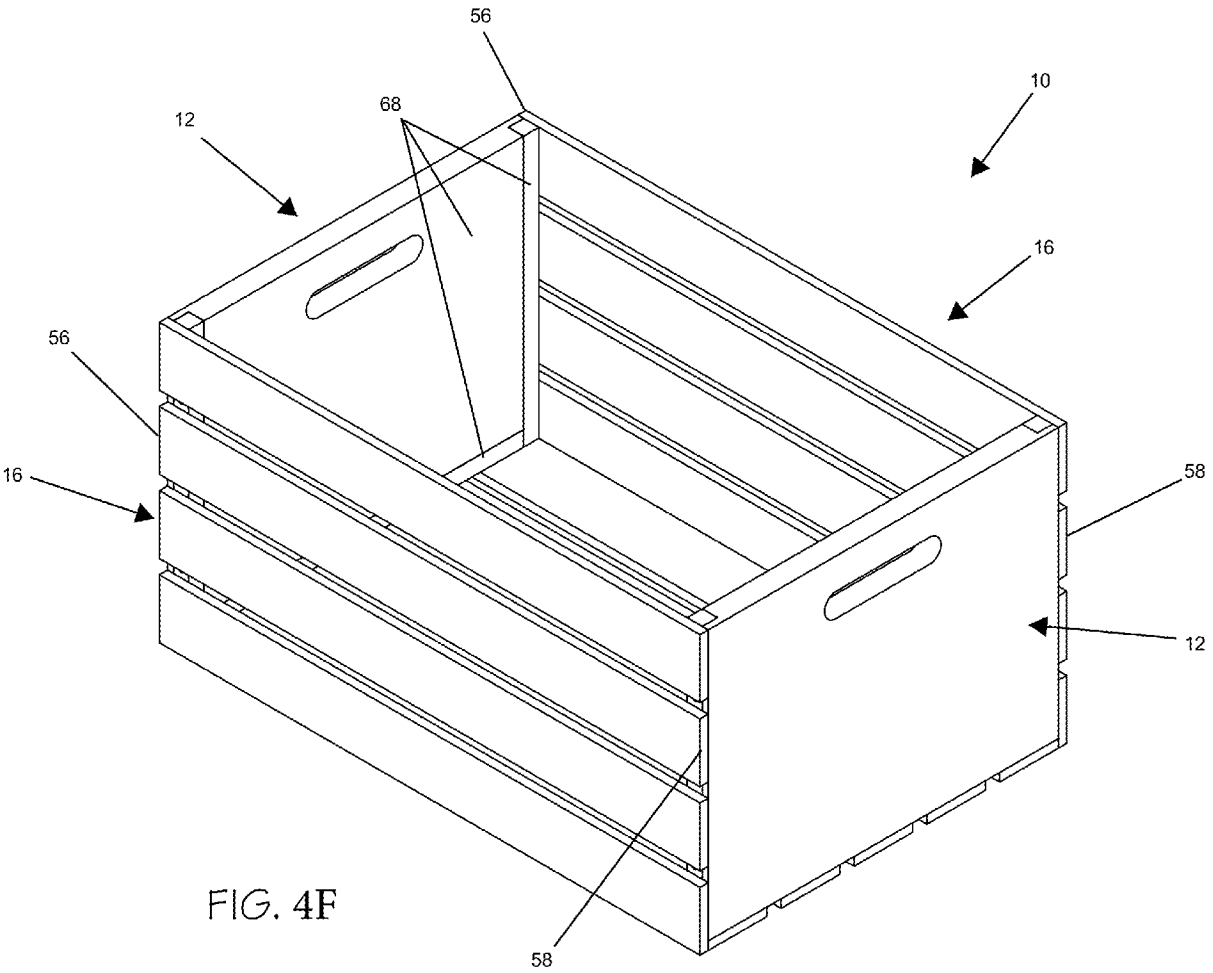
FIG. 4F is front perspective view of the assembled knockdown crate of the version shown in FIG. 1.

With reference to FIG. 4C and FIG. 4D, the knockdown crate 10 is assembled and fastened together by utilizing one or more means for connecting 72 or screws. The one or more means for connecting 72 or screws pass through the exterior side of the side panel 16 transverse connection members 50 and the bottom panel 14 transverse connection members 36 into the respective end panel 12 interior grooves 26, wherein there are two screws per transverse connection member 36 and 50 positioned equidistant from the center 51 of the transverse connection members 36 and 50. This provides a strong and sturdy construction when the knockdown crate is in the assembled configuration.

Preferably as illustrated, each side panel 16 and bottom panel 14 are connected each by four screws 72, two passing through each transverse connection member on each panel, connecting the respective connection member with the respective end panel 12 interior groove 26.

Figure 5A:
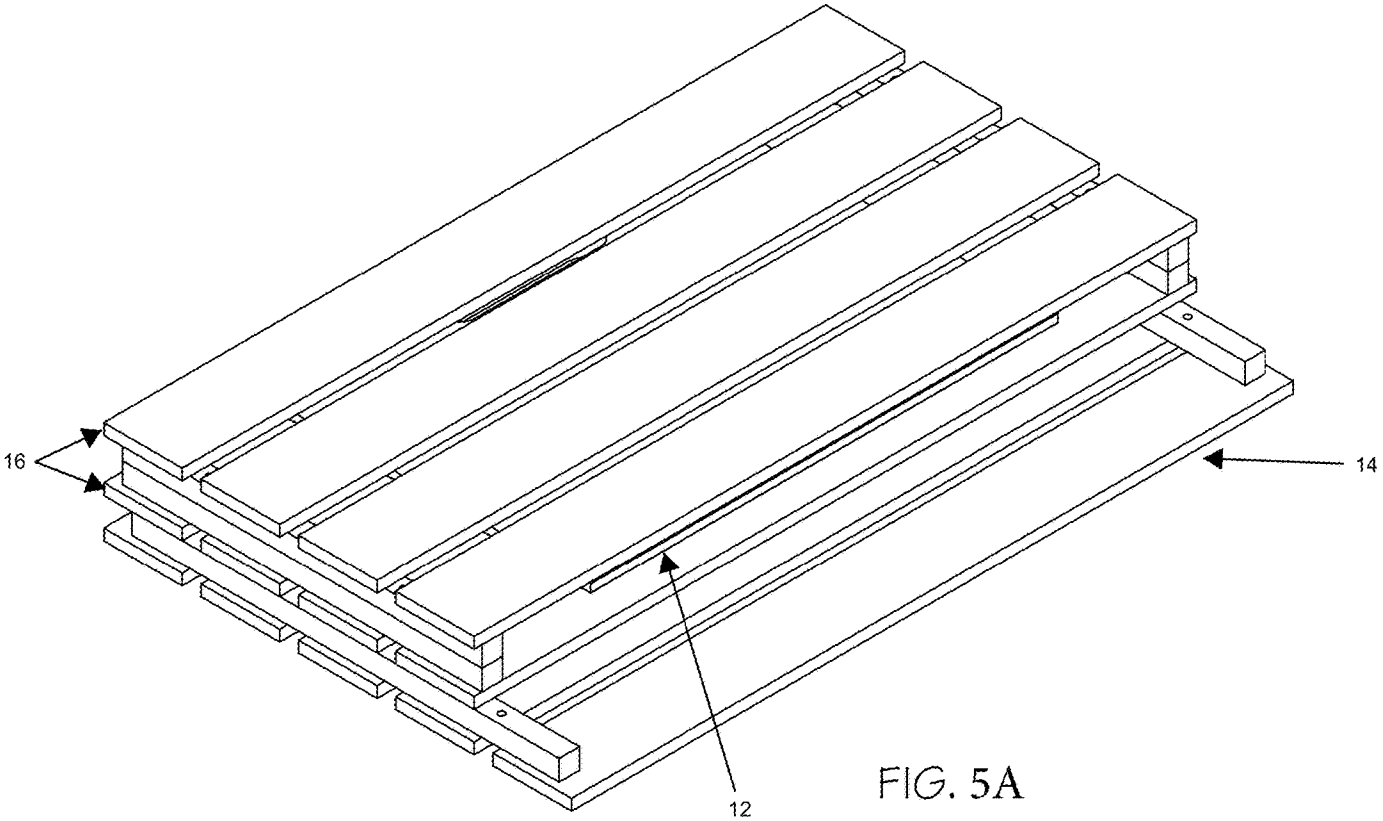
FIG. 5A is front perspective view of the unassembled, stacked knockdown crate of the version shown in FIG. 1.
Figure 5B:
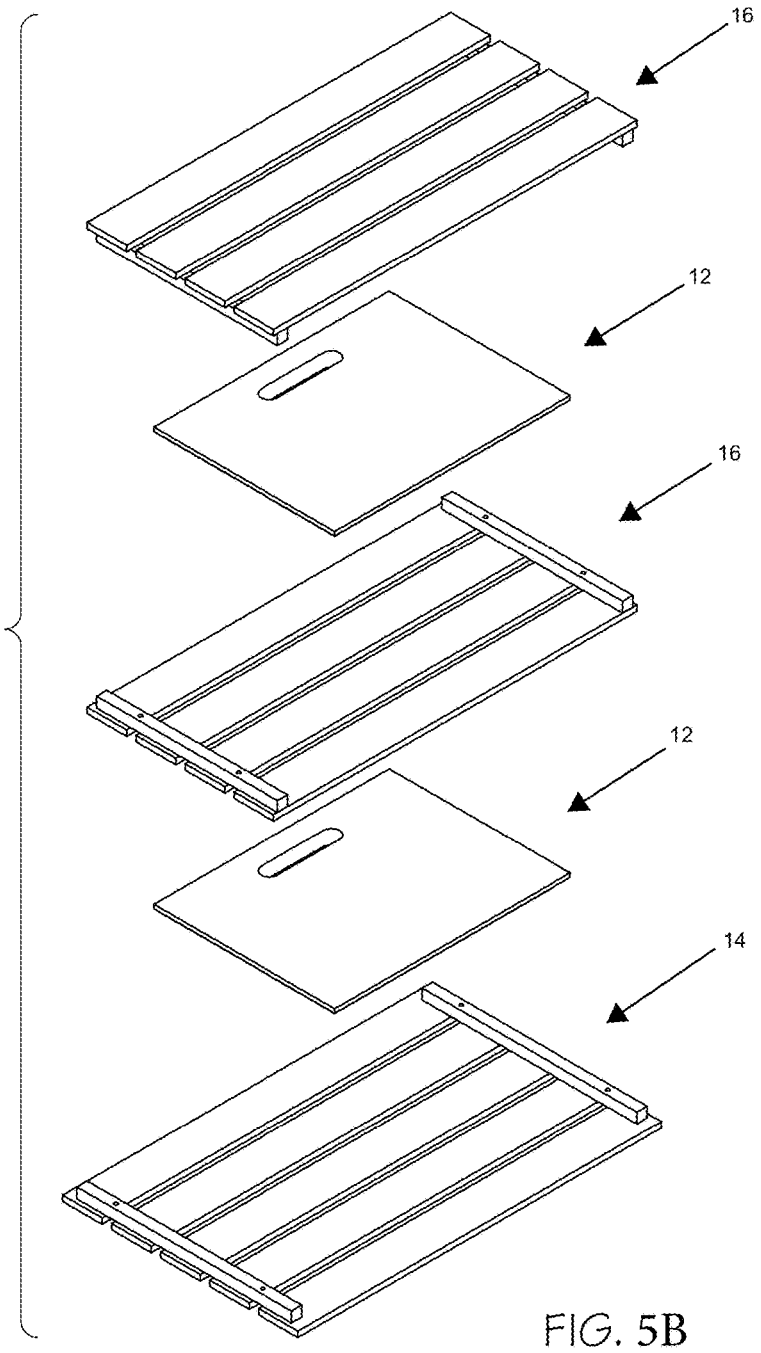
FIG. 5B is an exploded perspective view of the unassembled, stacked knockdown crate of the version shown in FIG. 1.
Figure 5C:
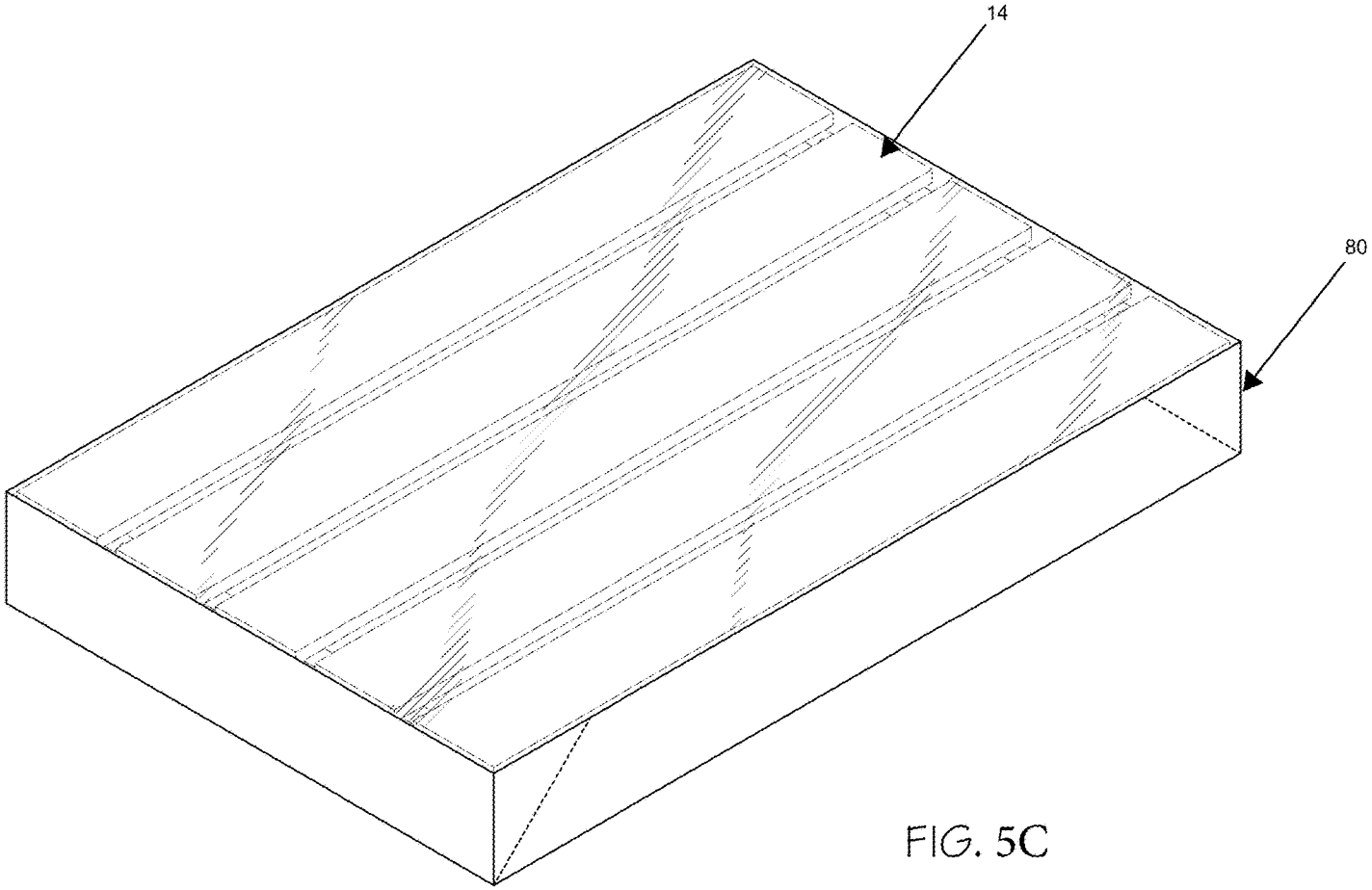
FIG. 5C is front perspective view of the unassembled, packaged knockdown crate of the version shown in FIG. 1.
Figure 8:
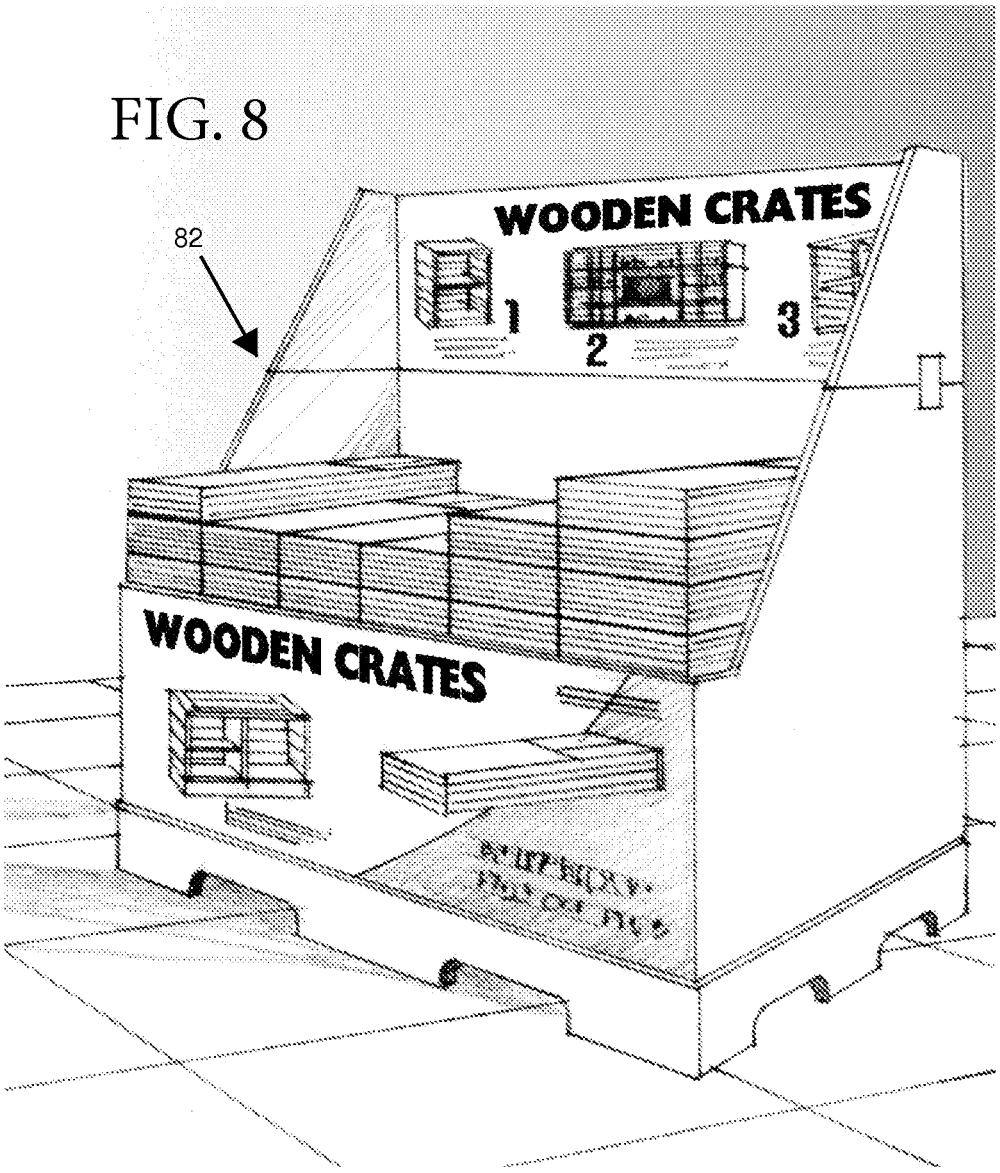
FIG. 8 is an illustrative perspective view of the unassembled, packaged knockdown crate put on display and offered for sale at a retail location.

Moreover, the invention may comprise a unique method of packaging and displaying the crates for sale at a retail location. As illustrated by the figures, particularly FIG. 5A-FIG. 5C, the first step in the unique method (FIG. 5B) is to (a) provide at least one unassembled knockdown crate 10 which includes (i) two end panels 12, each with a bottom edge 20 and opposing side edges 22 and 24, each edge comprising an interior groove 26 extending the length thereof; (ii) a bottom panel 14 comprising a plurality of longitudinal slats 34 and two transverse connection members 36 connecting the plurality of longitudinal slats 34 in parallel, the transverse connection members 36 have a geometric cross section which seat with the interior grooves 26 of the bottom edges 20 of the two end panels 12; and (iii) two side panels 16 each comprising a plurality of longitudinal slats 48 and two transverse connection members 50 connecting the plurality of longitudinal slats in parallel, the transverse connection members 50 have a geometric cross section which seat with the interior grooves 26 of the opposing side edges 22 and 24 of the two end panels 12 respectively. The second step is to (b) uniformly stack and pack each unassembled knockdown crate into a rectangular tray 80, wherein the bottom panel 14, two end panels 12, and two side panels 16 are each individually stacked one atop of the other. Next, (c) each rectangular tray 80 containing an unassembled knockdown crate 10 is stacked into a display 82 box (FIG. 8), wherein the exterior of the display box advertises the contents therein for display at a retail location and finally, and (d) each display box 82 containing the packaged knockdown crates are put on display and offered for sale at the retail location.

In an alternate version of the invention, the step of (b) uniformly stacking and packing each unassembled knockdown crate 10, further comprises positioning the bottom panel 14 above the side panels 16 and end panels 12 within the tray 80, and shrink wrapping the tray 80 in order to secure the knockdown crate 10 within the tray 80. This provides a potential purchaser with the ability to view the quality and construction of the knockdown crate 10 while in the packaging during display at the retail location.

In yet another version of the method of packaging and display, the first step (a) providing an unassembled knockdown crate 10; (b) uniformly stacking each unassembled knockdown crate 10, wherein the bottom panel 14, two end panels 12, and two side panels 16 are each individually stacked one atop of the other; (c) shrink wrapping each of the uniformly stacked unassembled knockdown crates 10, whereby providing a potential purchaser with view of the quality and construction of the knockdown crate 10 while in the packaging during display at the retail location; (d) loading each shrink wrapped knockdown crate 10 into a display box 82, wherein the exterior of the display box advertises the contents therein for display at a retail location; and finally (e) displaying at least one display box 82 at the retail location, offering the packaged knockdown crates for sale.

Figure 6A:
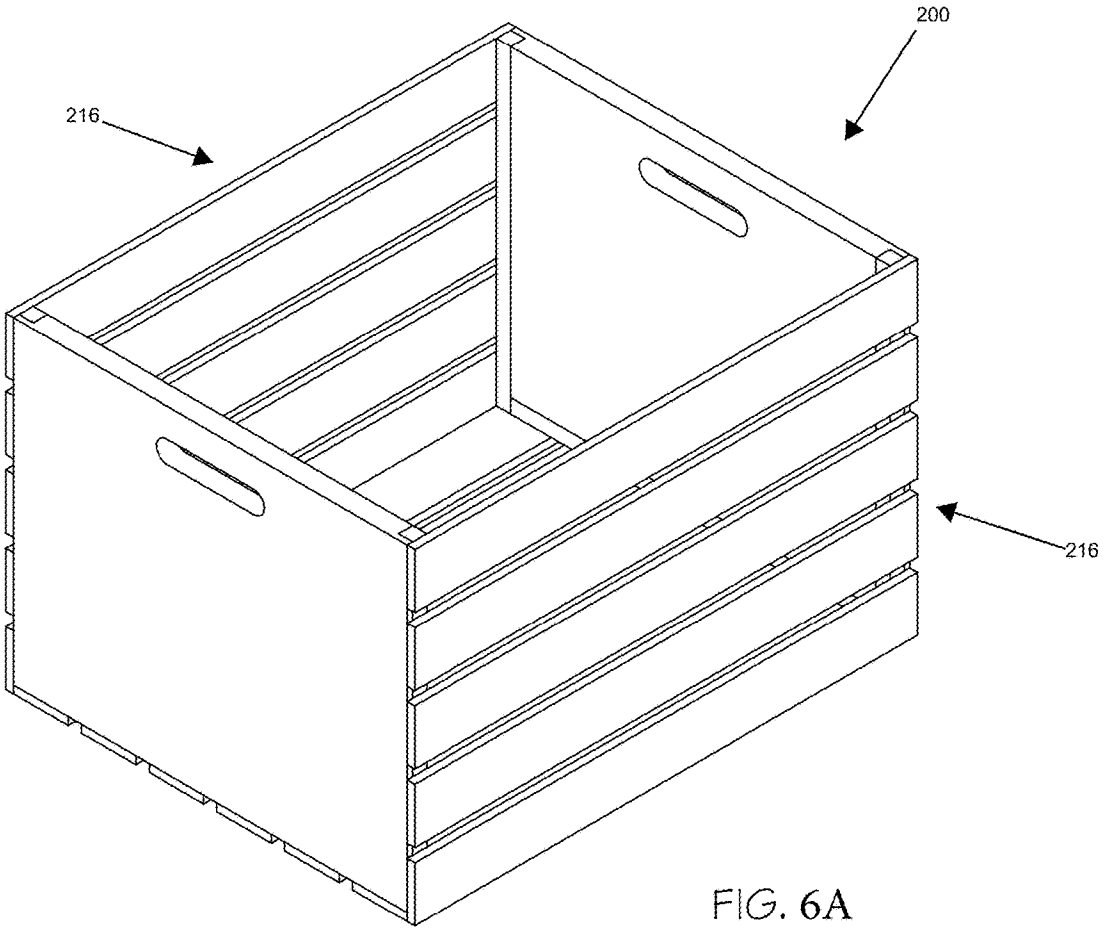
FIG. 6A is a front perspective view of a second version of the knockdown crate embodying the principles of the invention.
Figure 6B:
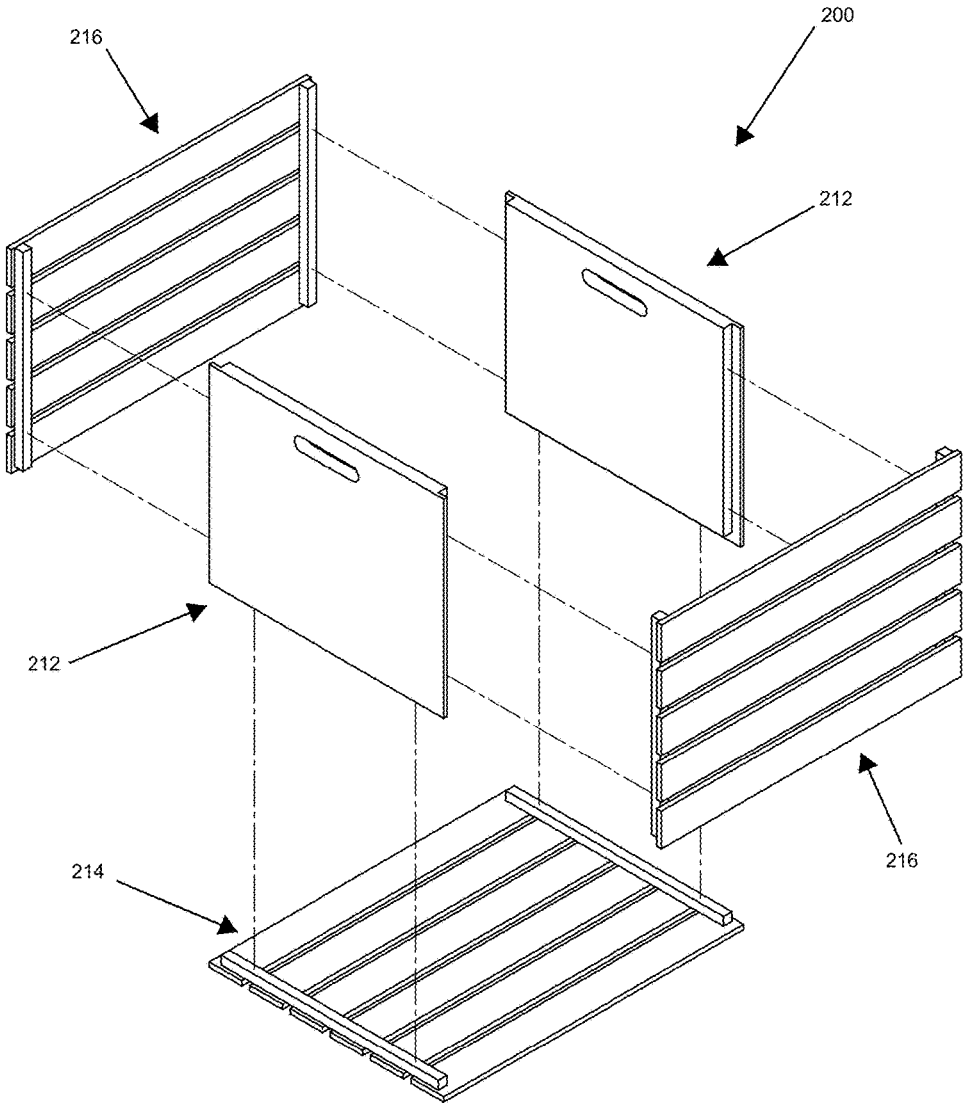
FIG. 6B is an exploded perspective view of the unassembled parts of the version shown in FIG. 6A.
Figure 7A:
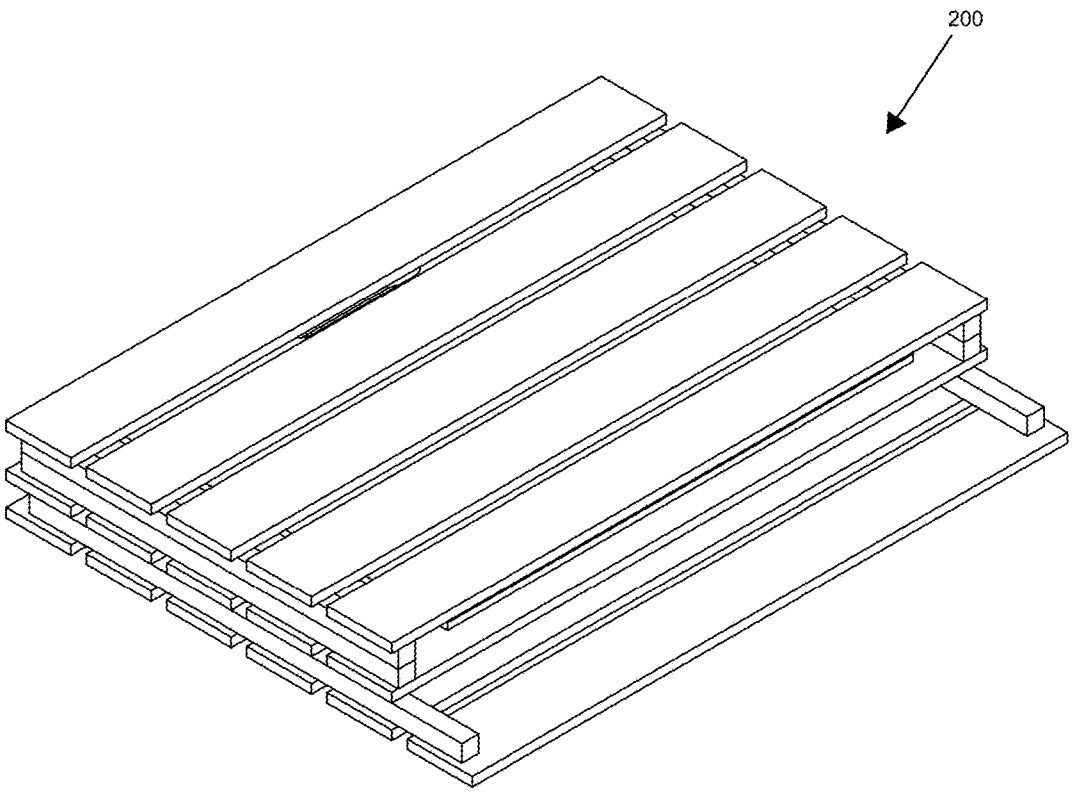
FIG. 7A is front perspective view of the unassembled, stacked knockdown crate of the version shown in FIG. 6A.
Figure 7B:
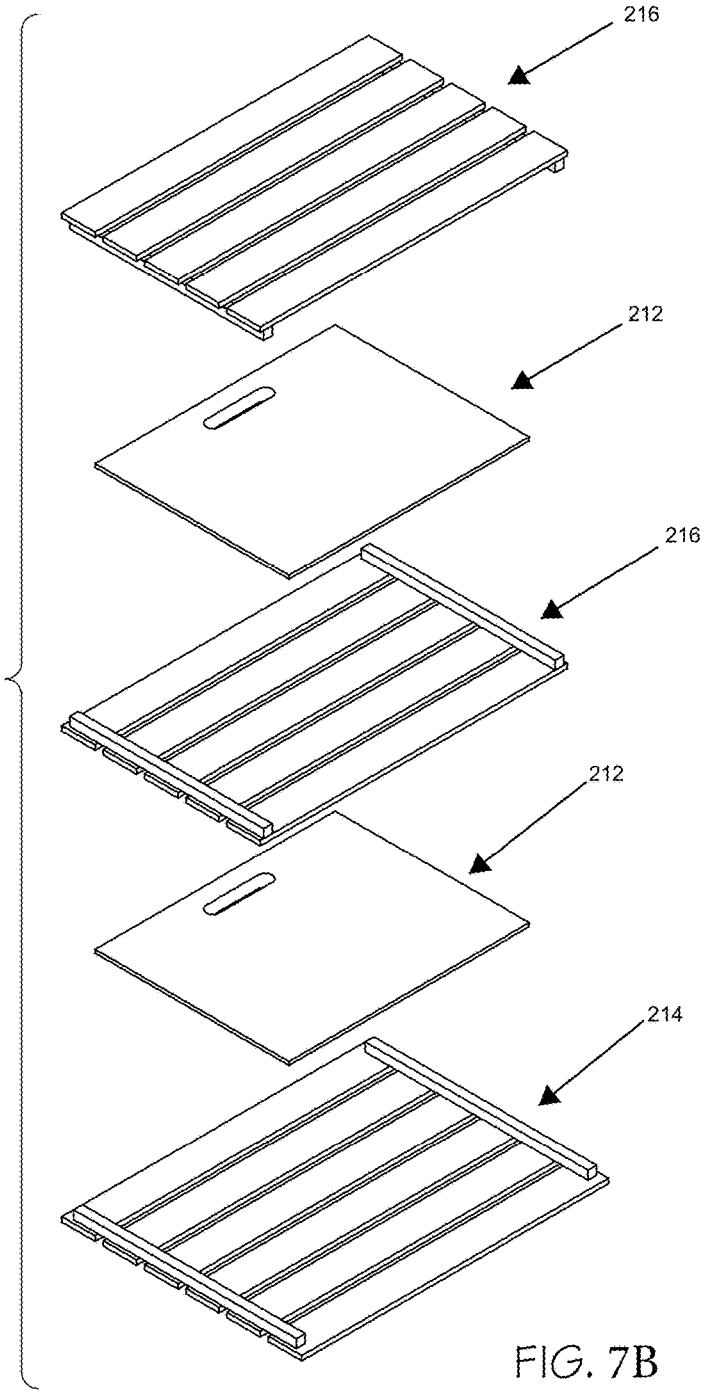
FIG. 7B is an exploded perspective view of the unassembled, stacked knockdown crate of the version shown in FIG. 6A.
Figure 7C:
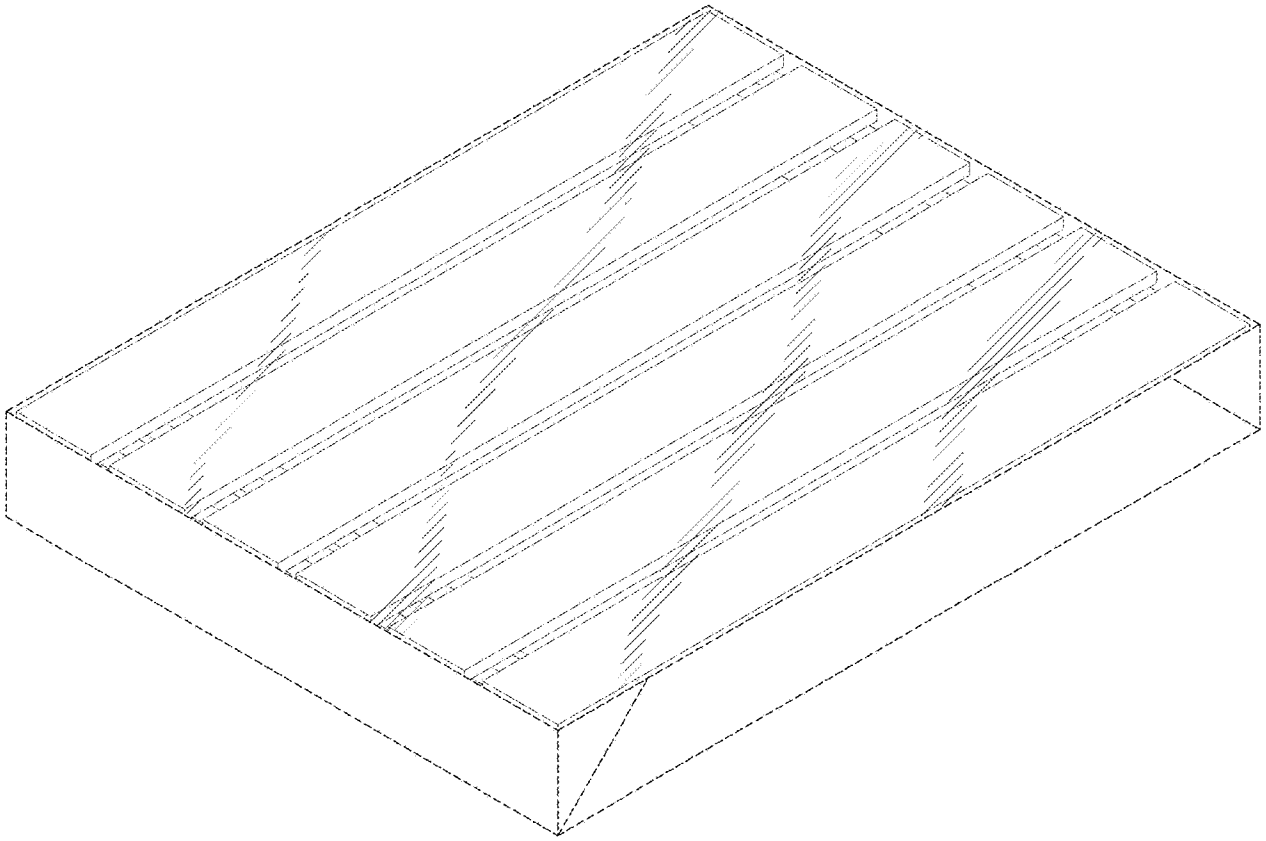
FIG. 7C is front perspective view of the unassembled, packaged knockdown crate of the version shown in FIG. 6A.

FIG. 6A and FIG. 6B depict a second version 200 embodying the principals of the invention. In the version, the bottom panel 214 includes six longitudinal slats 234 and the two side panels 216 include five longitudinal slats 248. As depicted by FIG. 7A-FIG. 7C, the version 200 can be packaged and displayed similar to the first version 10.

The present invention can be made in any manner and of any material chosen with sound engineering judgment. Preferable, the knockdown crate 10 is constructed of wood, plastic or of other materials that are strong, lightweight, long lasting, economic, and ergonomic.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A knockdown crate, comprising:

(a) two end panels each having a bottom edge and opposing side edges, each edge comprising an interior groove extending the length thereof defining therebetween an end wall interior surface;

(b) a bottom panel comprising a plurality of longitudinal slats and two transverse connection members connecting the plurality of longitudinal slats in parallel, the transverse connection members have a geometric cross section which seat with the interior grooves of the bottom edges of the two end panels and a longitudinally extending, interior facing flat surface positioned to fit parallel and flush with the respective end wall interior surface while crate is assembled, wherein the transverse ends of the bottom panel overlap the bottom edge of their respective end panels forming a right angle assembled edge; and (c) two side panels, each comprising a plurality of longitudinal slats and two transverse connection members connecting the plurality of longitudinal slats in parallel, the transverse connection members have a geometric cross section which seat with the interior grooves of the opposing side edges of the two end panels respectively and a longitudinally extending, interior facing flat surface positioned to fit parallel and flush with the respective end wall interior surface while crate is assembled, wherein the transverse ends of the two side panels overlap the opposing side edges of their respective end panels forming a right angle assembled edge and the bottom edges of the two side panels overlap the longitudinal edges of the bottom panel form a right angle assembled edge;

wherein while the crate is assembled, at each end panel, the respective end transverse connection member flat surfaces and the respective end wall interior surface combine to form uniform, flat end wall.

2. The knockdown crate of claim 1, wherein the bottom panel transverse connection members and the two side panel transverse connection members are adapted to seat with their respective end panel interior grooves forming uniform, flat interior end walls when the knockdown crate is assembled.

3. The knockdown crate of claim 1, wherein the bottom panel transverse connection members and the two side panel transverse connection members are rectangular in horizontal cross section; and wherein each interior groove has an L-shaped horizontal cross section defining two longitudinally extending perpendicular flat surfaces adapted to seat with their respective transverse connection members.

4. The knockdown crate of claim 1, further comprising one or more means for connecting the two side panels and the bottom panel with the two end panels.

5. The knockdown crate of claim 4, wherein the one or more means for connecting is one or more screws that pass through the exterior side of the side panel transverse connection members and the bottom panel transverse connection members into the respective end panel interior grooves.

6. The knockdown crate of claim 5, wherein there are two screws per transverse connection member positioned equidistant from the center of the transverse connection member.

7. The knockdown crate of claim 1, wherein each end panel further comprises an elongated handle opening.

8. A knockdown crate, comprising:

(a) two end panels, each with a bottom edge and opposing side edges, each edge comprising an interior groove extending the length thereof defining therebetween an end wall interior surface, wherein each interior groove has an L-shaped horizontal cross section defining two longitudinally extending perpendicular flat surfaces;

(b) a bottom panel comprising a plurality of longitudinal slats and two transverse connection members connecting the plurality of longitudinal slats in parallel, the transverse connection members have a rectangular horizontal cross section which seat with the interior grooves of the bottom edges of the two end panels and a longitudinally extending, interior facing flat surface positioned to fit parallel and flush with the respective end wall interior surface while crate is assembled, wherein the transverse ends of the bottom panel overlap the bottom edge of their respective end panels forming a right angle assembled edge;

(c) two side panels each comprising a plurality of longitudinal slats and two transverse connection members connecting the plurality of longitudinal slats in parallel, the transverse connection members have a rectangular horizontal cross section which seat with the interior grooves of the opposing side edges of the two end panels respectively and a longitudinally extending, interior facing flat surface positioned to fit parallel and flush with the respective end wall interior surface while crate is assembled, wherein the transverse ends of the two side panels overlap the opposing side edges of their respective end panels forming a right angle assembled edge and the bottom edges of the two side panels overlap the longitudinal edges of the bottom panel form a right angle assembled edge; and (d) one or more means for connecting the two side panels and the bottom panel with the two end panels, the means for connecting passing through the exterior side of the side panel transverse connection members and the bottom panel transverse connection members into the respective end panel interior grooves;

wherein while the crate is assembled, at each end panel, the respective end transverse connection member flat surfaces and the respective end wall interior surface combine to form uniform, flat end wall.

* * * * *